US008290190B2

(12) United States Patent
Hau et al.

(10) Patent No.: US 8,290,190 B2
(45) Date of Patent: Oct. 16, 2012

(54) METHOD FOR SOUND PROCESSING IN A HEARING AID AND A HEARING AID

(75) Inventors: Ole Hau, Vanlose (DK); Carl Ludvigsen, Farum (DK)

(73) Assignee: Widex A/S, Lynge (DK)

( * ) Notice: Subject to any disclaimer, the term of this patent is extended or adjusted under 35 U.S.C. 154(b) by 205 days.

(21) Appl. No.: 12/887,637

(22) Filed: Sep. 22, 2010

(65) Prior Publication Data

US 2011/0013794 A1 Jan. 20, 2011

Related U.S. Application Data

(63) Continuation-in-part of application No. PCT/EP2008/061978, filed on Sep. 10, 2008.

(51) Int. Cl.
*H04R 25/00* (2006.01)

(52) U.S. Cl. ..... 381/320; 381/312

(58) Field of Classification Search ..... 381/2, 23.1, 381/60, 79, 94.3, 312, 317, 320; 600/559; 379/52

See application file for complete search history.

(56) References Cited

U.S. PATENT DOCUMENTS

| | | | | |
|---|---|---|---|---|
| 5,687,241 | A | 11/1997 | Ludvigsen | |
| 5,903,655 | A | 5/1999 | Salmi et al. | |
| 6,628,795 | B1 | 9/2003 | Ludvigsen | |
| 2002/0099538 | A1 | 7/2002 | Saito | |
| 2003/0012392 | A1 | 1/2003 | Armstrong | |
| 2005/0175198 | A1 | 8/2005 | Neumann | |
| 2006/0233408 | A1 | 10/2006 | Kates | |
| 2008/0144869 | A1 * | 6/2008 | Paludan-Mueller et al. | 381/320 |
| 2008/0181439 | A1 * | 7/2008 | Neumann | 381/312 |

FOREIGN PATENT DOCUMENTS

| | | | |
|---|---|---|---|
| EP | 0732036 | B1 | 5/1997 |
| EP | 1059016 | B1 | 5/2002 |
| WO | 03/081947 | A1 | 10/2003 |

* cited by examiner

*Primary Examiner* — Brian Ensey
(74) *Attorney, Agent, or Firm* — Sughrue Mion, PLLC

(57) ABSTRACT

A method for processing and controlling sound signals in a hearing aid is provided. The method comprises estimating a first (102) and a second (104) signal level of an electric input signal (101) based on a first (103) and a second (105) signal level estimator adapted for responding according to a first and a second speed respectively, where the second speed is lower than the first speed and where the estimated second signal level is subtracted from the estimated first signal level, thereby forming a third signal level (106). Subsequently a first and a second compressor gain control output are determined in a first (107) and second (109) compressor based on said third and second signal level respectively. Then the first and second compressor gain control outputs are summed and hereby a net gain control signal (111) is created. Finally the electric input signal is amplified in accordance with the net gain control signal and thereby creating an electric output signal (112). The invention also relates to a hearing aid operating according to said method.

18 Claims, 8 Drawing Sheets

METHOD FOR SOUND PROCESSING IN A HEARING AID AND A HEARING AID

RELATED APPLICATIONS

The present application is a continuation-in-part of application No. PCT/EP2008061978, filed on Dec. 10, 2008, in Denmark and published as WO2010028683 A1.

BACKGROUND OF THE INVENTION

1. Field of the Invention

The present invention relates to hearing aids. The invention further relates to methods of processing sound signals in hearing aids. The invention still further relates to controlling sound signals and, more particularly, to methods and hearing aid devices that process sound signals, in particular for hearing impaired persons by using a multitude of compressors.

In this application, a hearing aid should be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

The microphone in the hearing aid converts sounds from the surroundings into an analog, electrical signal. The digital signal processor in the hearing aid converts the analog electrical signal from the microphone into a digital signal by virtue of an analog-to-digital converter. Subsequent signal processing is carried out in the digital domain. The digital signal is split up into a plurality of frequency bands by a corresponding plurality of digital band-pass filters, each band-pass filter processing a separate frequency band. The plurality of band-pass filters is usually denoted a band-split filter. The signal processing in each frequency band comprises gain calculation and compression, compression being required because a hearing impairment is generally associated with a reduced dynamic range. After processing the signal in the separate frequency bands, the plurality of frequency bands are summed before converting the digital output signal into sound.

Digital hearing aids are thus capable of amplifying a plurality of different frequency bands of the input signal separately and independently and subsequently combining the result to extend over a coherent, audible range of frequencies, suitable for acoustic rendering. Part of the amplification process involves a compression algorithm for controlling the dynamics of each band separately, and the amplification gain and compressor parameters may be controlled separately for each band in order to tailor the sound reproduction to a specific hearing loss.

The compressors present in contemporary hearing aids usually have their settings optimized during the procedure of fitting the hearing aid to a user's hearing loss for the purpose of reproducing speech faithfully and comprehensibly. Other sounds are of course reproduced by the hearing aid as well, but the processing quality of speech signals is paramount.

Speech signals in noise are particularly difficult to understand by a hearing impaired person, and the optimization process thus takes this factor into account when the hearing aid is fitted to the user.

In this application the term "compressor system" is referred to as comprising a "signal level estimator" and a "compressor". The signal level estimator is referred to as a circuitry that supplies an estimated signal level to the compressor for use in the compressor as input. The compressor then calculates a signal gain value to be applied in the signal processing based on said input.

Furthermore the term "compression ratio" is referred to as the inverse of the slope of the input-output curve for the hearing aid. This curve illustrates the output sound pressure level as a function of the input sound pressure level. The term "knee point" is referred to as a point on the input-output curve, where the slope changes.

The compression characteristics of the slow and the fast compressor constitute the corresponding input-output function of the slow and fast compressor.

In this application the speed of the signal level estimator is referred to as "fast" when the estimated signal level responds fast to changes in the signal level estimator input signal and therefore follows the input signal relatively closely and is referred to as "slow" when the estimated signal level responds slowly to changes in the signal level estimator input signal and therefore can not follow the input signal fluctuations and becomes some kind of input signal average.

In this application the "envelope signal" is the signal level estimator input signal. The envelope signal is provided by transforming the acoustic input sound signal into an electric input signal, determining the absolute value of the electric input signal, and finally low pass filtering the absolute value of the electric input signal in order to extract the envelope signal.

In this application "attack time" and "release time" of the signal level estimator is a measure of the speed of the signal level estimator. Therefore the attack and release times of the signal level estimator are short when the speed of the signal level estimator is fast. However, in this application these terms "attack time" and "release time" are expressed by values measured in dB/s in order to make the signal level estimator speeds independent of the clock frequency for the signal level estimators. With this choice of units the speed of the signal level estimator is fast when the value of the "attack time" and "release time" is large.

The signal quality of a hearing aid with respect to both speech intelligibility and listening comfort depends on both the speed of the signal level estimator and on the characteristics of the compressor itself.

The sound reproduced by the hearing aid will cause a pumping sensation when the change in gain has such a speed and magnitude, that the hearing aid wearer perceives a variation in sound level even in a steady sound environment. Typically the hearing aid wearer will in this case describe the reproduced sound as unsteady.

A compressor system with a slow signal level estimator normally results in good signal quality. However the signal level at the onset of e.g. a speech segment may become unacceptably loud because the sudden increase in sound input level is not immediately tracked by the compressor system because of the latency of the slow signal level estimator. Equally, the latency of the slow signal level estimator prevents appropriate amplification of a soft input signal following immediately after a sudden drop in sound input level (e.g. at the end of a spoken sentence). A fast signal level estimator will better trace the temporal characteristics of dynamic signals and hereby relieve the issues mentioned above for a slow signal level estimator. However, the signal quality generally decreases with a compressor based on a fast signal level estimator relative to a slow signal level estimator. Furthermore, the signal quality tends to degrade with increasing compression ratio, but on the other hand the compression ratio needs to be large enough to compress the dynamic range of the output signal adequately.

It is well known that the difference in speech intelligibility between normal hearing and hearing impaired subjects is larger in fluctuating noise than in stationary noise. In sound environments with highly fluctuating noise and a soft speaker it may therefore be advantageous to apply fast compression in order to straighten out the noise and hereby increase speech intelligibility for the hearing impaired.

A hearing aid with an improved compressor system providing greater flexibility with respect to the combination of the speed of the signal level estimators and the compression curve characteristics in order to improve the signal quality and speech intelligibility is thus desired.

2. Prior Art

European patent publication EP-A-1059016 describes a hearing aid device where the attack and release times are adjusted in response to the detected sound level to a relatively short duration providing fast gain adjustment at high input and/or output sound levels and to a relatively long duration providing slow gain adjustment at low input and/or output sound levels. By this method, the sound will be controlled with long attack and release times at low sound levels, at which the transfer function provides a compressor characteristic and the reproduced sound is very sensitive to pumping or vibrating sound effects when the gain varies with time. On the other hand, at elevated sound levels at which the reproduced sound approaches the clipping or pain threshold, the sound is controlled with short attack and release times.

Furthermore it is known in the art to have a multi-channel hearing aid with two separate compression systems working in parallel, where one system acts relatively slowly and has 15 channels, and the other system acts relatively faster and has 4 channels. The relative impact of the two compression systems is constantly adjusted. At soft to moderate sound levels the system responds more slowly, and with increasing sound levels the impact of the faster acting compression path increases.

The hearing aids described above do not allow the compressor system to be controlled by a slow signal level estimator at relatively high sound input levels (e.g. cocktail party situation), even though such a feature would be advantageous with respect to speech intelligibility.

WO-A1-03/081947 provides a method for a dynamic determination of time constants to be used in a detection of the signal level of an input signal of unknown level in an electric circuit. The method comprises the following steps: feed the input signal through an auxiliary level detection means that is reacting faster to changes in the input sound signal level than the detection of the signal level as a whole, feed either the input signal or the output of the auxiliary level detection means through a guided level detection means, which is arranged with a guided time constant, and where the guided level detection means outputs an estimate of the level of the input signal, analyze the outputs of the auxiliary and the guided level detector means and determine the time constant of the guided level detection means based on this analysis.

US-A1-2006/0233408 describes a hearing aid wherein the compressor adapts the attack and release time constants in response to input signal fluctuations or variations. In one embodiment, increases in the input signal level above the average signal level lead to decreased attack and release time constants.

Thus, none of the systems described above disclose the possibility of independently setting the compression curve characteristics for two compressors, which are working together, based on a slow and a fast signal level estimation respectively.

Therefore none of the systems described above allow the free adjustment of fast acting compression characteristics for optimizing to a specific sound environment without changing the input-output function prescribed by the fitting rationale.

SUMMARY OF THE INVENTION

It is therefore a feature of the present invention to provide a method and a hearing aid for processing sound signals having both improved speech quality and gain control properties.

The invention, in a first aspect, provides a method for processing sound signals in a hearing aid a method for processing sound signals in a hearing aid, said method comprising transforming an acoustic input sound signal into an electric input signal, estimating a first signal level of the electric input signal based on a first signal level estimator adapted for responding according to a first speed, estimating a second signal level of the electric input signal based on a second signal level estimator adapted for responding according to a second speed, said second speed being lower than said first speed, subtracting said second signal level from said first signal level, thereby forming a third signal level, determining in a first compressor a first compressor gain control output based on said third signal level, determining in a second compressor a second compressor gain control output based on said second signal level, summing said first and second compressor gain control outputs thereby creating a net gain control signal, amplifying said electric input signal in accordance with the net gain control signal thereby creating an electric output signal and transforming said electric output signal into an acoustic output signal.

This provides a method that allows the compressor system to adapt to a changing sound environment in a simple manner. Additionally the method according to the present invention in this aspect allows the compression characteristics, i.e. gain, compression ratio and knee points, of the slow and the fast compressor, to be arranged independently of each other, whereby speech intelligibility and listening comfort may be improved.

The invention, in a second aspect, provides a hearing aid, comprising an input transducer adapted for transforming an acoustic input sound signal into an electric input signal, a first signal level estimation unit and a second signal level estimation unit, the first signal level estimation unit adapted for having a first speed and the second signal level estimation unit adapted for having a second speed which is lower than the first speed, a subtraction unit configured to subtract the output of the second signal level estimation unit from the output of the first signal level estimation unit thereby forming a third signal level, a first and a second compressor, each compressor configured to determine a respective compressor output based on using respectively said third signal level and said output of the second signal level estimation unit, a summing unit configured to sum the compressor outputs thereby providing a net gain control output, a multiplication unit configured for multiplying said electric input signal by the net gain control output thereby creating an electric output signal, and an output transducer adapted for transforming the electric output signal into an acoustic sound signal.

Further advantageous features appear from the dependent claims.

Still other feature of the present invention will become apparent to those skilled in the art from the following description wherein the invention will be explained in greater detail.

BRIEF DESCRIPTION OF THE DRAWINGS

The invention will be readily understood from the following detailed description in conjunction with the accompanying drawings. As will be realized, the invention is capable of other different embodiments, and its several details are capable of modification in various, obvious aspects all without departing from the invention.

Accordingly, the drawings and descriptions will be regarded as illustrative in nature and not as restrictive. In the drawings.

DETAILED DESCRIPTION

Figure 1:
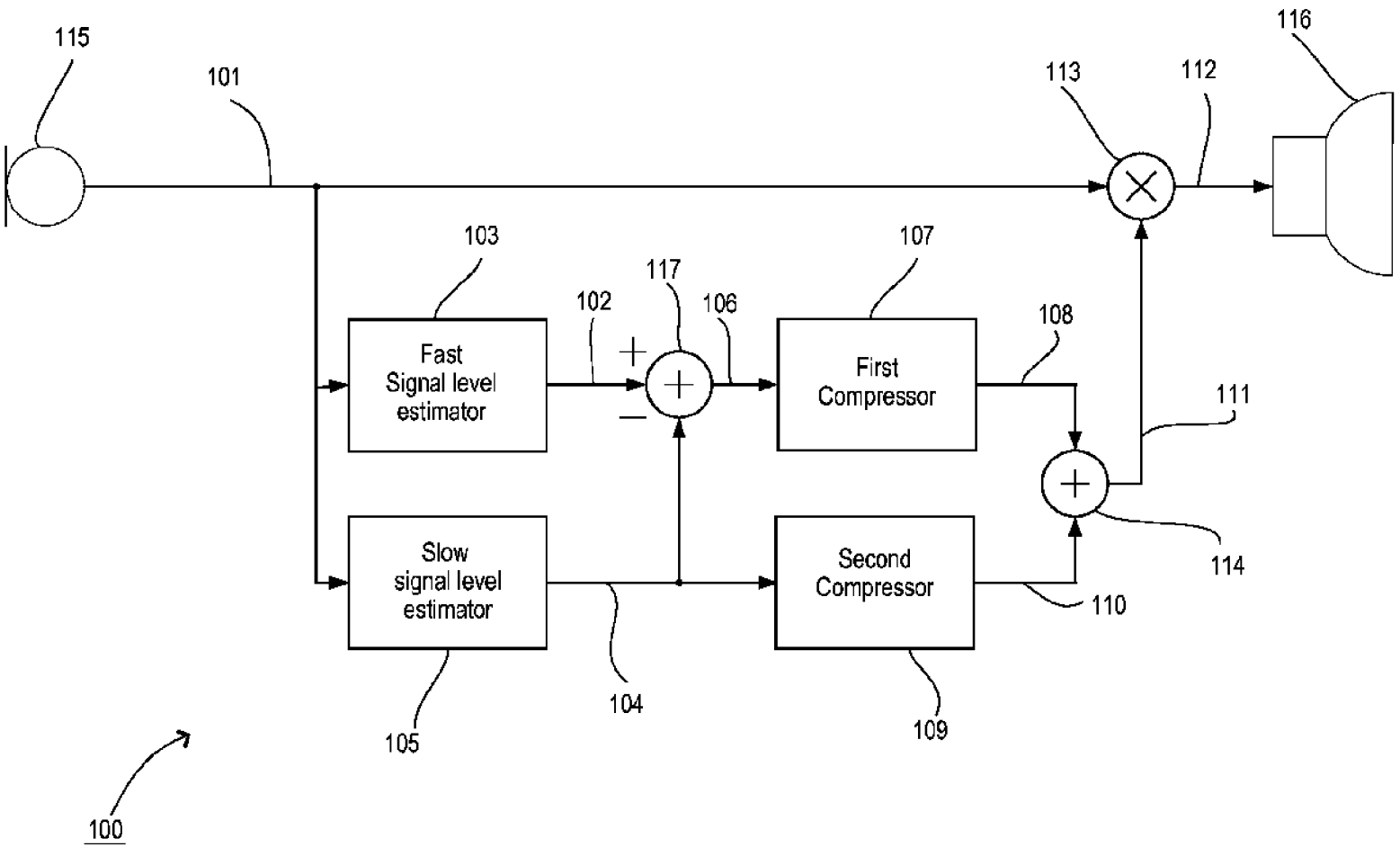
FIG. 1 illustrates a highly schematic and simplified block diagram of a hearing aid according to an embodiment of the present invention.

FIG. 1 shows a highly schematic and simplified block diagram of a first embodiment of a hearing aid according to the present invention. The signal path of the hearing aid 100 comprises an input transducer or microphone 115 transforming an acoustic input signal into an electric input signal 101. This signal is split up into two branches, namely a gain branch, which is used to calculate the gain factor and a signal branch, which is used to carry the signal intended for having its level modified in the gain multiplier 113. The electric input signal in the gain branch is supplied to a first signal level estimator 103 and a second signal level estimator 105 that are adapted for responding according to a fast and slow speed respectively. The output from the signal level estimators is therefore a first estimated signal level 102 based on fast signal level estimation and a second estimated signal level 104 based on a slow signal level estimation.

Subsequently the second estimated signal level 104 is provided for two branches, namely a compressor input branch, which is used as input to a second compressor 109, which is adapted for an input based on a slow signal level estimation, and a subtraction branch which is used to subtract said second estimated signal level 104 from said first estimated signal level 102 in the subtraction unit 117. The resulting signal level 106 is then used as input to a first compressor 107. The first compressor 107 and the second compressor 109 then determine a gain based on their respective compressor input levels and compressor characteristics. In the following the first and second signal level estimators and compressors are sometimes referred to as the fast and slow signal level estimators and compressors respectively. Reference signs 108 and 110 refer to the compressor gain control outputs produced by the first compressor 107 and second compressor 109 respectively. A summing unit 114 then sums the compressor outputs to produce a net gain control signal 111. A multiplier 113 is provided in the signal branch to amplify the electric input signal 101 by multiplying it in accordance with the net gain control signal 111 to produce an amplified signal 112 which may then be transformed by an output transducer 116 into an acoustic sound signal.

It will be appreciated that the use of the simple subtraction unit 117 and summing unit 114 is a consequence of the estimated signal levels (102, 104 and 106) and compressor gain control outputs (108, 110 and 111) being given in dB.

Furthermore, it will be appreciated that gain may be set in an easy and intuitive way based on the slow compressor characteristics only. This may be done using any fitting rationale known in the art.

Furthermore it will be appreciated that while the characteristics of the slow compressor are typically determined by the chosen fitting rationale, the fast compressor characteristic may be chosen independently of this rationale and it thus becomes possible to e.g. choose that fast compression is always carried out at a low compression ratio whereby signal quality is improved.

Additionally, the attack and release times of the fast and slow compressors, respectively, may be set such that no "speech like" modulation of the noise results, hereby avoiding the pumping behaviour that might otherwise degrade the signal quality.

Figure 2:
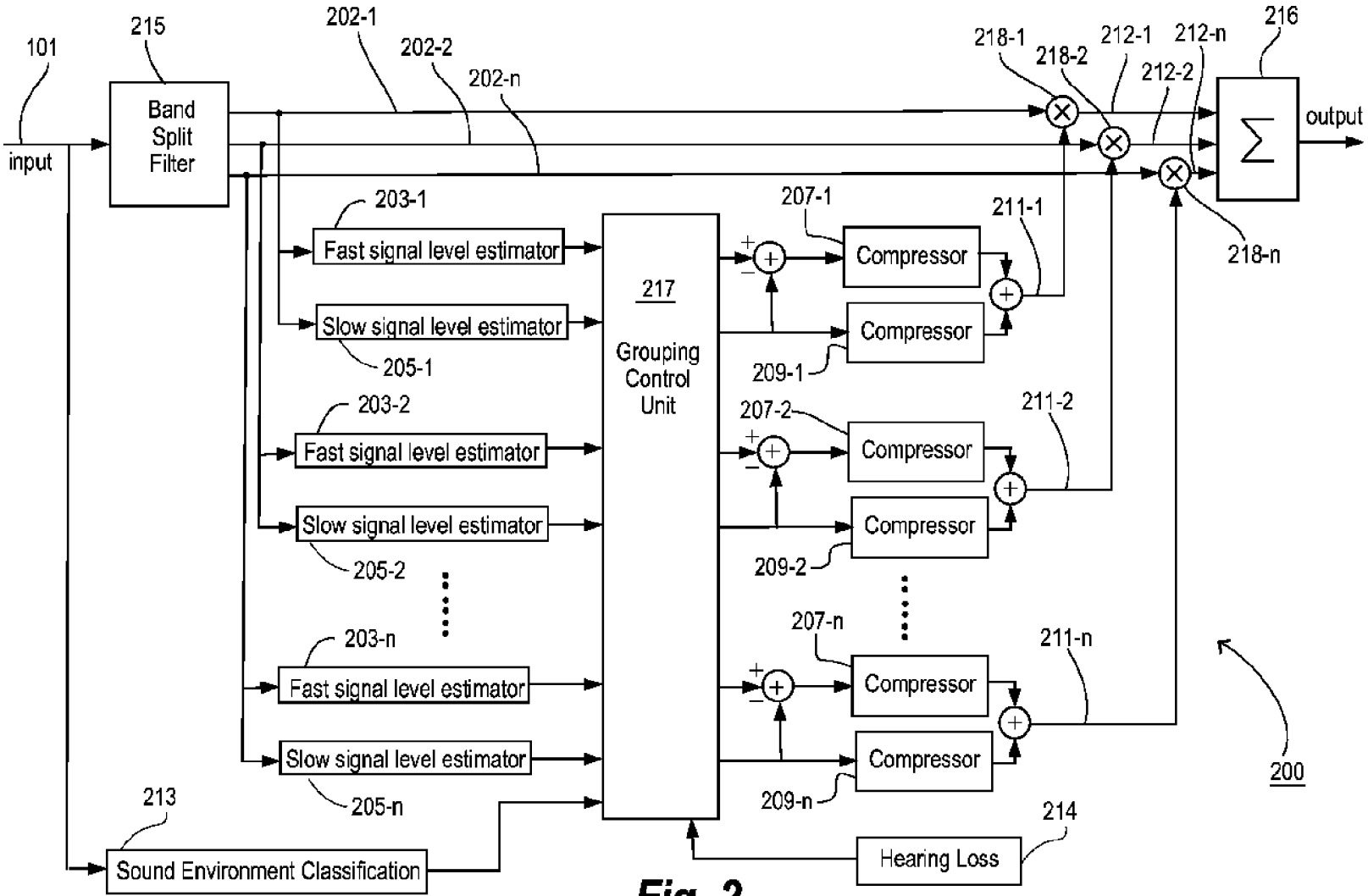
FIG. 2 illustrates a block diagram of a part of a hearing aid according to an embodiment of the present invention.

FIG. 2 shows a block diagram of a part of a hearing aid of another embodiment according to the present invention, which comprises multi-band compression processing. The signal path of the hearing aid 200 comprises an input transducer or microphone (not shown in the figure) transforming an acoustic input sound signal into an electric input signal 101, a band split filter 215 receiving the electric input sound signal and splitting this electric input sound signal into a number of frequency bands to obtain band split signals 202-1, 202-2, . . . , **202-*n*. Only three frequency bands are shown in FIG. 2. even though a hearing aid may encompass more than 10 frequency bands, e.g. 15 frequency bands. Each of the individual band split signals is provided for two branches, namely a gain branch, which is used to calculate the gain factor and a signal branch, which is used to carry the signal to have its level modified in one of the gain multipliers 218-1, 218-2, . . . , 218-*n*. Each of the individual band split signals in the gain branch is fed to a set of a first signal level estimator 203-1, 203-2, . . . , 203-*n* and a second signal level estimator 205-1, 205-2, . . . , 205-*n*. The first and second signal level estimators are adapted for responding according to a fast and slow speed respectively. The outputs from the signal level estimators are supplied to a grouping control unit 217, adapted for modifying the outputs from the signal level estimators. This modification is further described in the description of FIG. 3**.

Thus the output from each of the slow signal level estimators 205-1, 205-2, . . . , **205-*n* is processed in the grouping control unit 217 and is subsequently provided for two branches, a slow compressor input branch and a subtraction branch, which is used to subtract a signal level based on a slow signal level estimation from a signal level based on the corresponding fast signal level estimation, the output of which having likewise been processed in the grouping control unit 217. The signal level resulting from this subtraction forms the input to the corresponding fast compressor 207-1, 207-2, . . . , 207-*n***.

Each of the compressors 207-1, 207-2, . . . , **207-*n* and 209-1, 209-2, . . . , 209-*n* then determines a gain control signal based on its individual compressor input level and the individual compressor characteristic. The individual compressor gain control signal produced by the compressors 207-1, 207-2, . . . , 207-*n* and 209-1, 209-2, . . . , 209-*n* are subsequently summed in a summing unit to produce a net compressor gain control signal 211-1, 211-2, . . . , 211-*n*** in each of the frequency bands.

A gain multiplier 218-1, 218-2, . . . , **218-*n* is provided in the signal branch of each of the frequency bands in order to amplify the corresponding band split signals 202-1, 202-2, . . . , 202-*n* through multiplication by the respective net compressor gain to produce amplified signals 212-1, 212-2, . . . , 212-*n*, which are summed in summing unit 216 resulting in an output signal that may then be transformed by an output transducer (not shown in the figure) into an acoustic sound signal. The grouping control unit 217 is configured as a function of data about the hearing aid wearers hearing loss 214 and may furthermore be adaptively controlled using the sound environment classification unit 213**.

Figure 3:
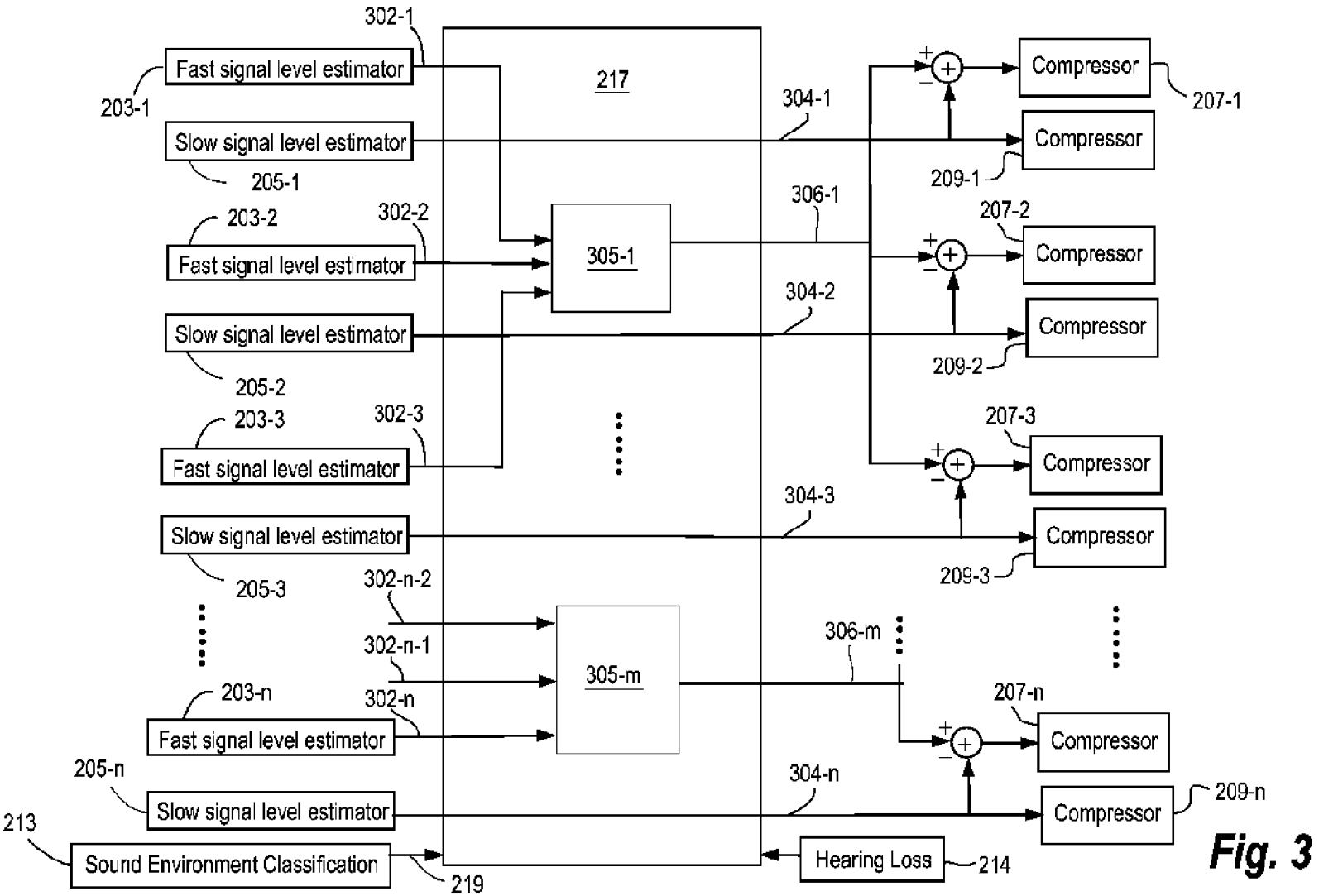
FIG. 3 illustrates a representative block diagram comprising a grouping control unit for use in a hearing aid according to an embodiment of the present invention.

FIG. 3 shows a more detailed representation of a part of a hearing aid according to an embodiment of the present invention. Each band split signal is fed (not shown in the figure) to a corresponding set of a first signal level estimator 203-1, 203-2, . . . , **203-*n* and a second signal level estimator 205-1, 205-2, . . . , 205-*n***. The first and second signal level estimators are adapted for responding according to a fast and slow speed respectively.

The outputs from the signal level estimators are all supplied to a grouping control unit 217. In this particular embodiment the outputs 304-1, 304-2, . . . , **304-*n* from the slow signal level estimators pass through the grouping control unit 217 unmodified and the outputs 302-1, 302-2, . . . , 302-*n* from the fast signal level estimators have been arranged in groups of three adjacent frequency bands by a set of decision rule units 305-1, . . . , 305-*m*, which may apply the max function (i.e. selecting the maximum estimated signal level among the considered group of frequency bands) or any other mathematical function in order to form, as output from each of the decision rule units, a modified first signal level 306-1, . . . , 306-*m*. The output from each of the decision rule units 305-1, . . . , 305-*m* is subsequently split up into three branches carrying the modified first signal level and wherefrom the corresponding second signal level 304-1, 304-2, . . . , 304-*n* is subtracted, thereby providing a third signal level that is input to the fast compressors 207-1, 207-2, . . . , 207-*n*. The arrangement and grouping of the outputs from the signal level estimators as well as the mathematical function applied to these outputs may be adaptively controlled using the signal 219 submitted by the sound classification unit 213**.

According to an alternative embodiment the grouping of the outputs from the signal level estimators are arranged such that all the compressors 207-1, 207-2, . . . , **207-*n* and 209-1, 209-2, . . . , 209-*n*** is supplied with an individual compressor input level.

Figure 4:
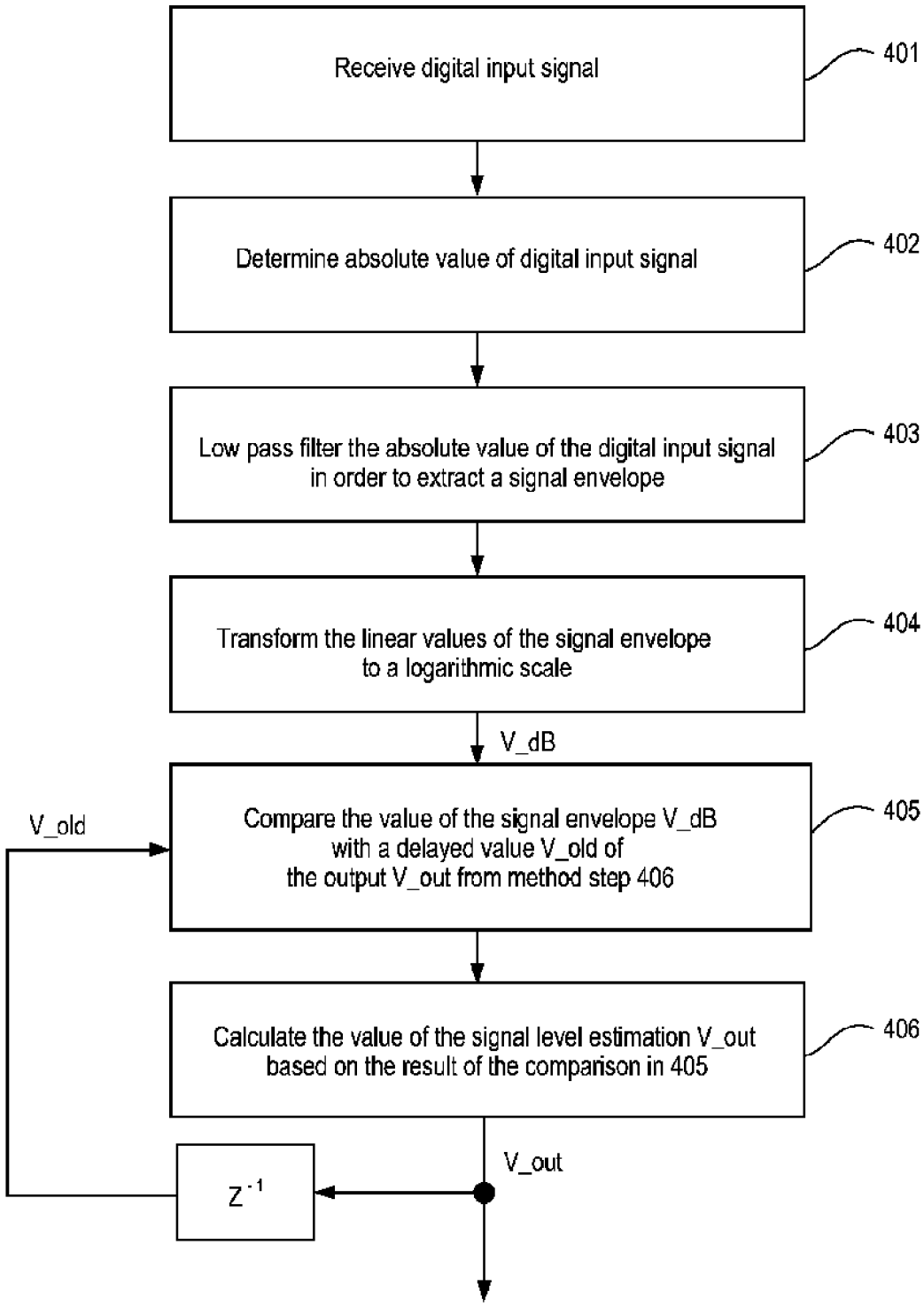
FIG. 4 illustrates a flow diagram illustrating a method for signal level estimation according to one embodiment of the present invention.

FIG. 4 shows a flow diagram of signal level estimation according to one embodiment of the invention. This signal level estimation is, according to an embodiment, performed within a hearing aid device such as the hearing aid 200 illustrated in FIG. 2. In method step 401 a digital signal is received, and in step 402 the absolute value of the signal is determined. In a next step 403 the absolute value of the signal is low pass filtered in order to extract the envelope of the signal. The linear values of the envelope signal are then transformed to a logarithmic scale in step 404. These values are used as input to the signal level estimator. In step 405 the logarithmic value of the signal envelope is compared with a delayed value of the output from the signal level estimation.

Dependent on this comparison the output value of the signal level estimation is found in step 406 by either adding a step value to the delayed output value or subtracting a step value from the delayed output value. Hereby a fast signal level estimation is obtained when the step value is relatively large and a slow signal level estimation is obtained when the step value is relatively small. Furthermore, the value that is added to the delayed output needs not be the same as the value that is subtracted from the delayed output. In a preferred embodiment the added value will be significantly larger than the subtracted value.

The added step value may be denoted the attack time and the subtracted step value may be denoted the release time. According to an embodiment the speed of said fast signal level estimator (103, 203-1, . . . , **203-*n*) results in attack times higher than 2000 dB/s and the speed of said slow signal level estimator (105, 205-1, . . . , 205-*n***) results in attack times lower than 50 dB/s. It may seem contradictory to use the terms attack and release time for values measured in dB/s. Alternatively, attack time and release time may be denoted attack response rate and release response time respectively.

Generally a signal level estimator may be considered fast when the lowest of the attack and release times is larger than 200 dB/s and a signal level estimator may be considered slow when the lowest of the attack and release times is smaller than 5 dB/s.

According to an embodiment the digital signal received in method step 401 is sampled with a speed of 32 kHz and the low pass filter used in method step 403 has a cut off frequency of 15 Hz. Following the low pass filtering the sample rate is reduced with a factor of 16, giving a sample rate of 2 kHz in the signal level estimator. The added step value is 5000 dB/s and 17 dB/s in the fast and slow signal estimators respectively. The subtracted step value is 500 dB/s and 2 dB/s in the fast and slow signal estimators respectively.

Having this choice of step values in the signal level estimator the estimated signal level is similar to a 90% percentile estimation. The principle of percentile estimation is further described in EP-A1-0732036.

Figure 5:
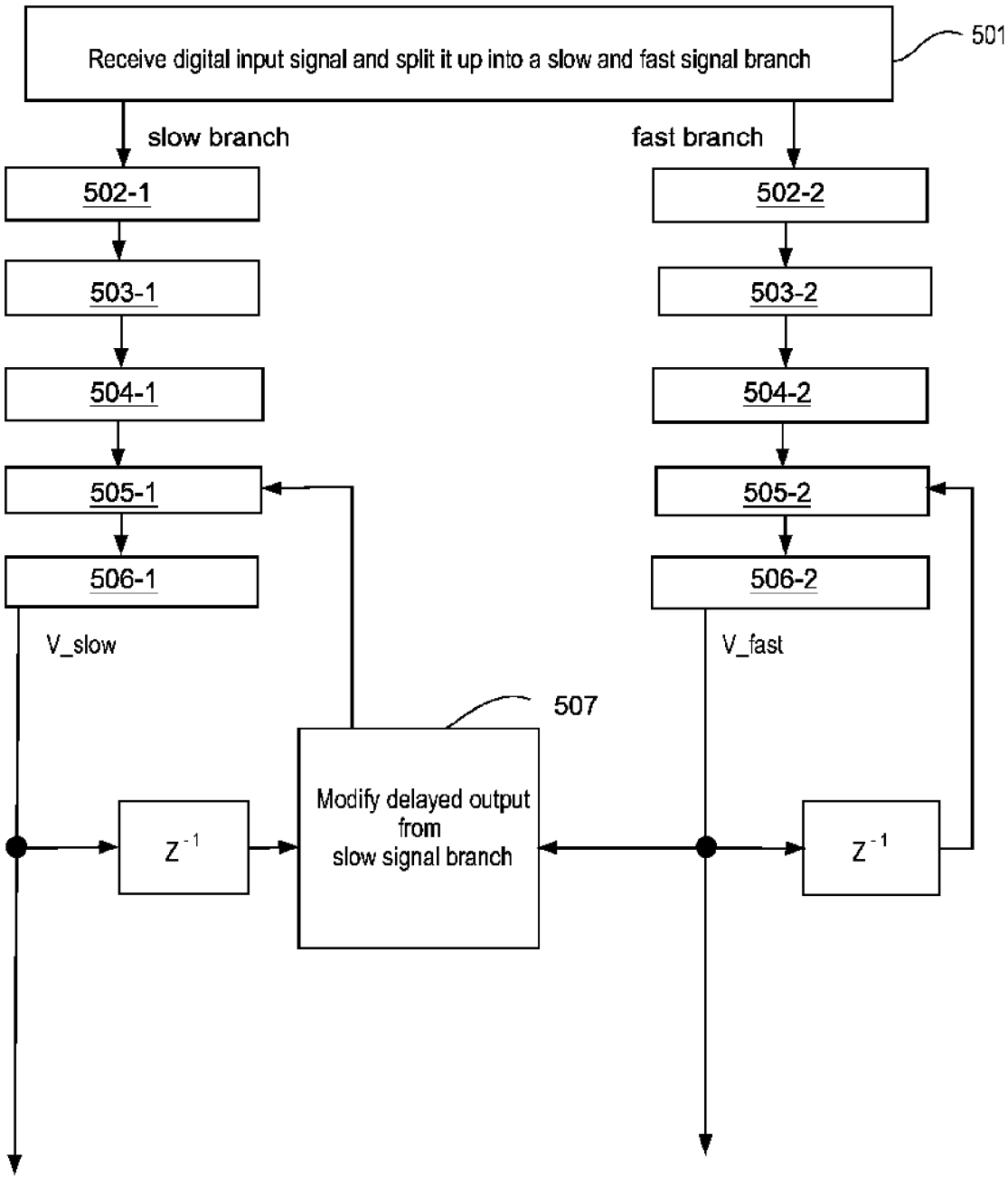
FIG. 5 illustrates a flow diagram illustrating another method for signal level estimation according to another embodiment of the present invention.

FIG. 5 shows a flow diagram of an advanced signal level estimation according to yet another embodiment of the invention. In method step 501 the input digital signal is received and subsequently divided into two signal branches, which may be denoted the fast and the slow branch. The following steps 502-1, 502-2-506-1, 506-2 that are similar to the steps 402-406, are carried out in each branch independently. In step 507 the delayed value of the output from method step 506-1 in the slow branch is modified before being used as input in the method step 505-1 in the slow branch. This modification consists of comparing the delayed value of the output from method step 506-1 in the slow branch with the non-delayed value of the output from the corresponding method step 506-2 in the fast branch.

If the difference between these two values is larger than a given threshold value and the delayed value of the output from method step 506-1 in the slow branch is larger than the non-delayed value of the output from the corresponding method step 506-2 in the fast branch, then the delayed output value from method step 506-1 in the slow branch is modified to be equal to the non-delayed value of the output from method step 506-2 in the fast branch plus said predetermined threshold value.

If, on the other hand, this delayed value of the output from method step 506-1 in the slow branch is smaller than the non-delayed value of the output from the corresponding method step 506-2 in the fast branch, then the delayed output value from method step 506-1 in the slow branch is modified to be equal to the non-delayed value of the output from method step 506-2 in the fast branch minus the predetermined threshold value. If the difference between the delayed value of the output from method step 506-1 in the slow branch and the non-delayed value of the output from the corresponding method step 506-2 in the fast branch is smaller than the threshold value, then the delayed value of the output from method step 506-1 in the slow branch is not modified. Hereby the speed of the slow signal level estimation may be increased when the input signal is highly fluctuating.

According to an embodiment the digital signal received in method step 501 is sampled with a speed of 32 kHz and the low pass filter used in method step 503 has a cut off frequency of 15 Hz. Following the low pass filtering the sample rate is reduced with a factor of 16, giving a sample rate of 2 kHz in the signal level estimator. The added step value is 5000 dB/s and 17 dB/s in the fast and slow signal estimators respectively. The subtracted step value is 500 dB/s and 2 dB/s in the fast and slow signal estimators respectively. The predetermined threshold value of method step 507 is 15 dB.

In an embodiment the predetermined threshold value depends on whether the delayed value of the output from method step 506-1 in the slow branch is smaller or larger than the non-delayed value of the output from the corresponding method step 506-2 in the fast branch. In the former case the threshold is 10 dB and in the latter case the threshold is 20 dB.

According to another embodiment the threshold value is determined adaptively based on the measured signal modulation. In yet another embodiment the signal modulation is determined as the difference between the 10% and 90% percentile.

Figure 6:
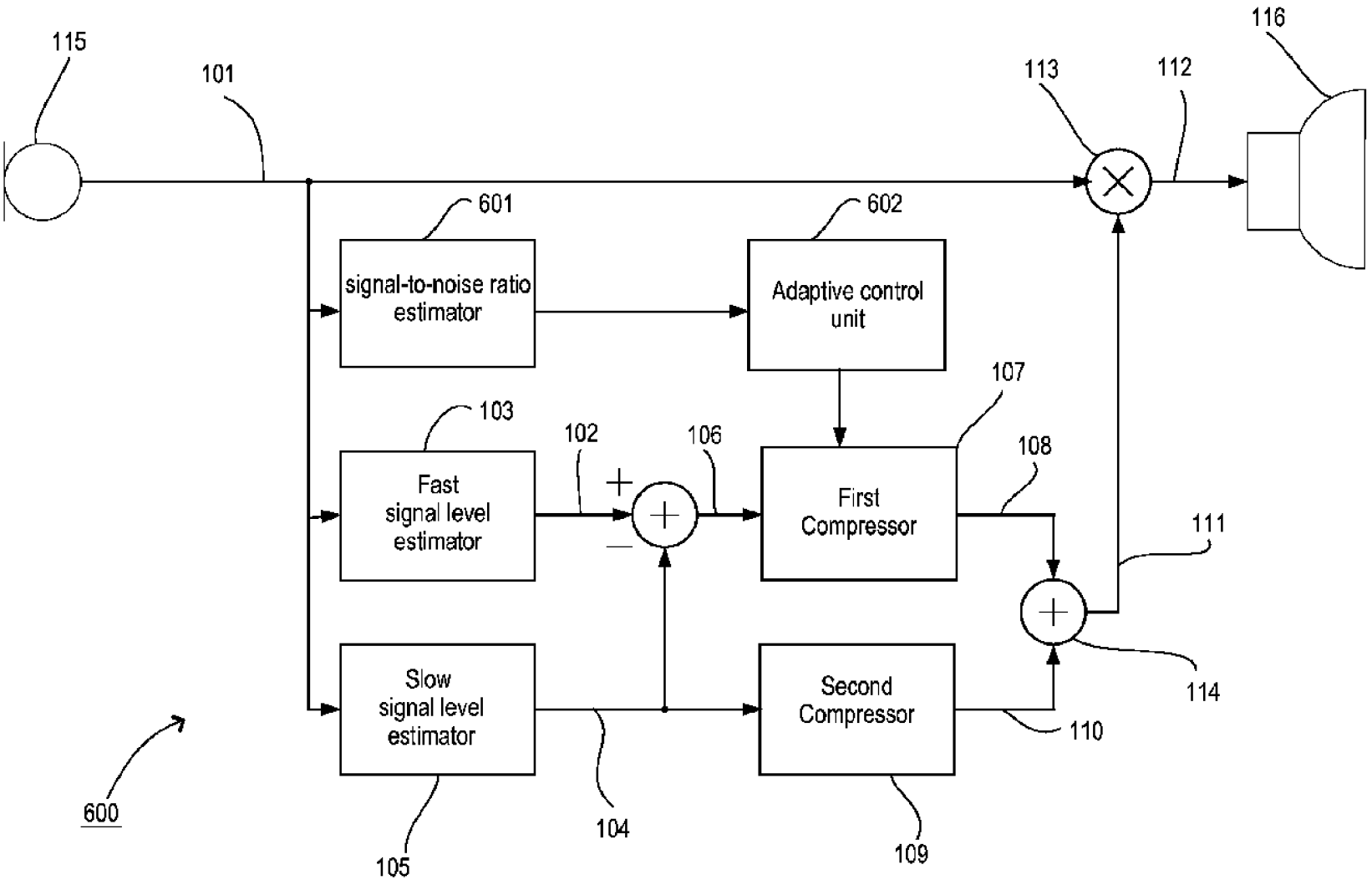
FIG. 6 illustrates another highly schematic and simplified block diagram of a hearing aid according to another embodiment of the present invention.

FIG. 6 shows a highly schematic and simplified block diagram of another embodiment of a hearing aid 600 according to the present invention. The diagram is identical to FIG. 1 with the addition of a signal-to-noise ratio estimator 601 and an adaptive control unit 602. The electric input signal in the gain branch is therefore led to both the signal level estimators 103 and 105 and the signal-to-noise ratio estimator 601. The resulting output signal from the estimator 601 is subsequently used as input for the adaptive control unit 602. The adaptive control unit may then adjust the compressor characteristics of the fast compressor 107 as a function of the input signal.

In a preferred embodiment the compression ratio is gradually increased when the signal-to-noise ratio is lower than 10 dB or higher than 20 dB.

In an alternative embodiment the signal-to-noise ratio estimator 601 is replaced by a noise estimator and in yet another embodiment the estimator 601 comprises both a signal-to-noise ratio estimator and a noise estimator.

Figure 7:
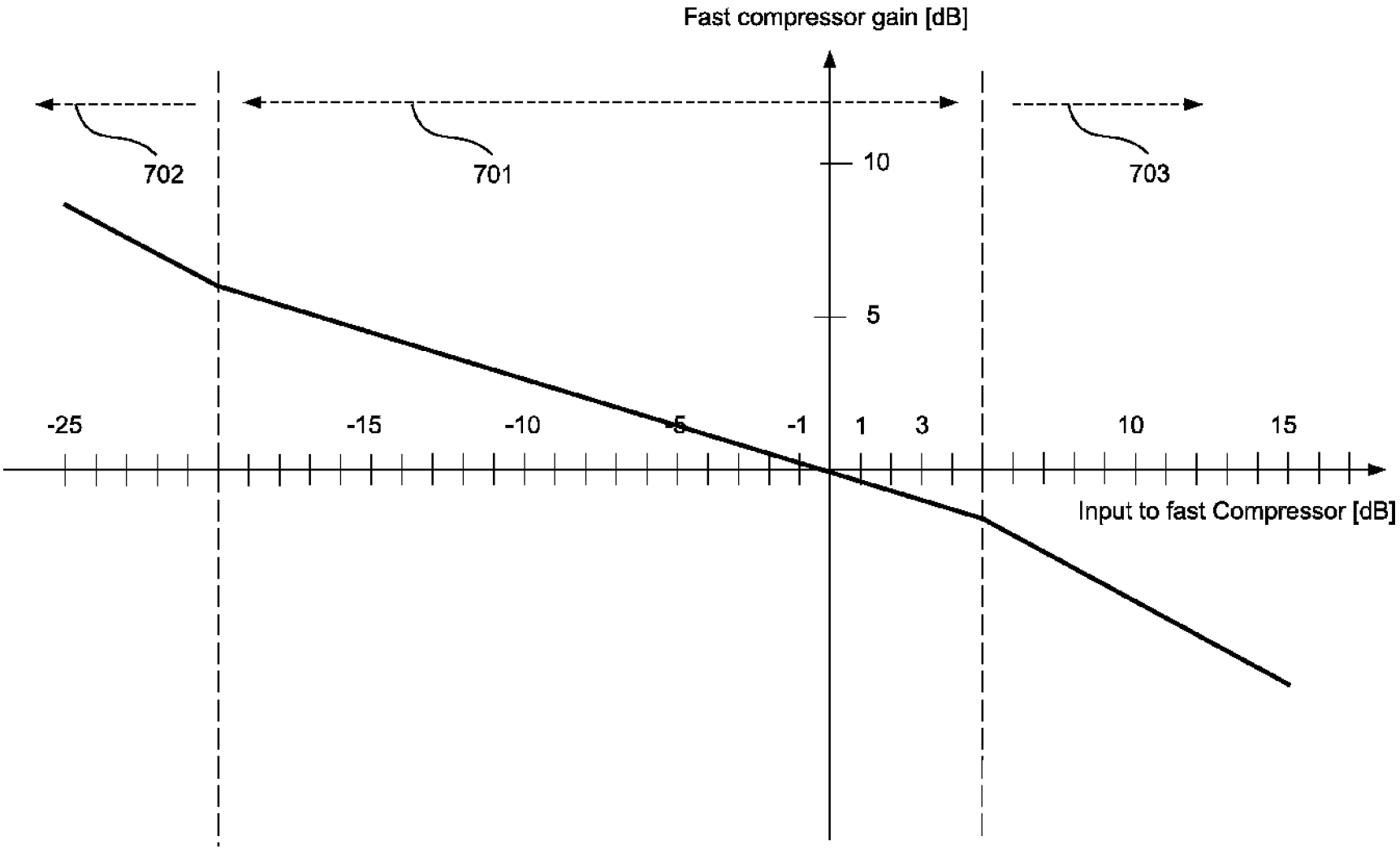
FIG. 7 illustrates an illustration of a fast compressor characteristic having a broken stick non-linearity according to yet another embodiment of the invention.

FIG. 7 is an illustration of a compressor characteristic for a fast compressor (107, 207-1, 207-2, . . . , **207-*n*, 307-1, 307-2, . . . , 307-*n*) according to yet another embodiment of the invention. The gain of the compressor is shown along the ordinate of the compressor characteristic. The input to the fast compressor (106) is shown along the abscissa of the compressor characteristic. Both the gain and the input to the fast compressor are given in decibel. The compressor characteristic comprises three input ranges separated by two knee points wherein the centre range 701 is characterised by having a lower compression range than the two outer ranges 702 and 703 and by having an absolute gain (i.e. the numerical value of the gain measured in dB) that is smaller than the absolute gain in the two outer ranges 702 and 703**.

The center range 701 spans a range of input signal levels of 25 dB. Hereby the dynamic range of the center range resembles typical values for the dynamic range of speech. Typically, the dynamic range of speech is larger than 20 dB and smaller than 35 dB. The center range is not set to be symmetrical around the 0 dB input signal level, instead it spans the range from (−) 20 dB to (+) 5 dB. The asymmetrical positioning of the center range depends on the choice of slow signal level estimator. If the slow signal level estimation is based on say a 90% percentile estimation, then the estimated slow signal level will be correspondingly closer to the upper limit of the dynamic range of speech (assuming that the noise level is significantly smaller than the speech level). In the present embodiment the chosen positioning of the center range is aimed at reflecting that the presumed 90% percentile slow signal level estimation is 5 dB below and 20 dB above the upper and lower limit of the assumed dynamic range respectively. The slope of the center range is set to (−) 0.3 and the slope of the two outer ranges is set to (−) 0.5. These values correspond to a compression ratio of 1.4 for the center range and 2.0 for the two outer ranges.

In another embodiment according to the present invention, the positioning and width of the center range is determined adaptively based on a sound classification. As an example it may be advantageous to widen the center range in case of a dominant speaker.

Thus this configuration allows an approach where the weighting of the fast compressor relative to the slow compressor is small in relatively stationary sound scenarios. However in situations with highly fluctuating input signals the weighting of the fast compression will increase rapidly. This feature is especially advantageous in sound scenarios where the available dynamic range is relatively limited and the SNR is moderate. Such sound scenarios are typically found at cocktail parties or while driving a car and listening to speech or music. This configuration may likewise be advantageous in situations with a soft speaker in highly fluctuating noise.

Figure 8:
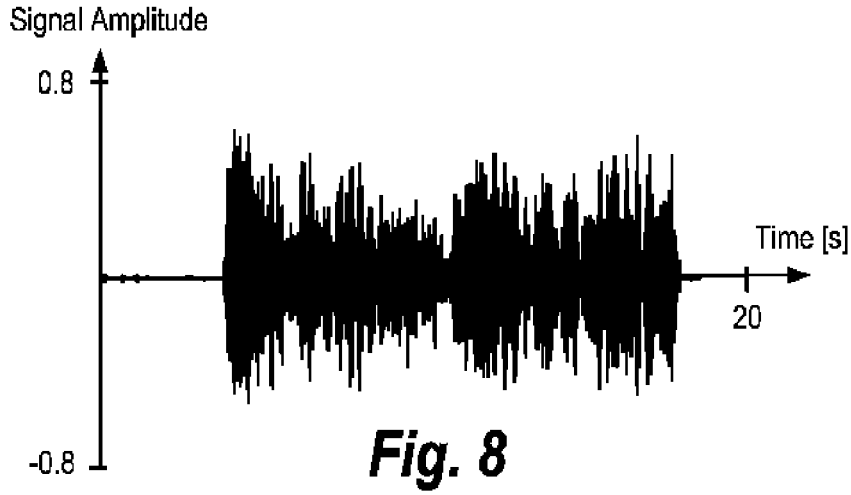
FIG. 8 illustrates a simulation of the amplitude variation of a typical speech sequence as function of time.

FIG. 8 is an illustration of the amplitude variation of a simulated speech sequence in the time domain. In the FIGS. 9, 10 and 11 it has been assumed that the signal of FIG. 8 is used as electric input signal 101 and based on this the corresponding amplified signal 112 for three different compressor configurations is simulated and illustrated in the FIGS. 9, 10 and 11.

Figure 9:
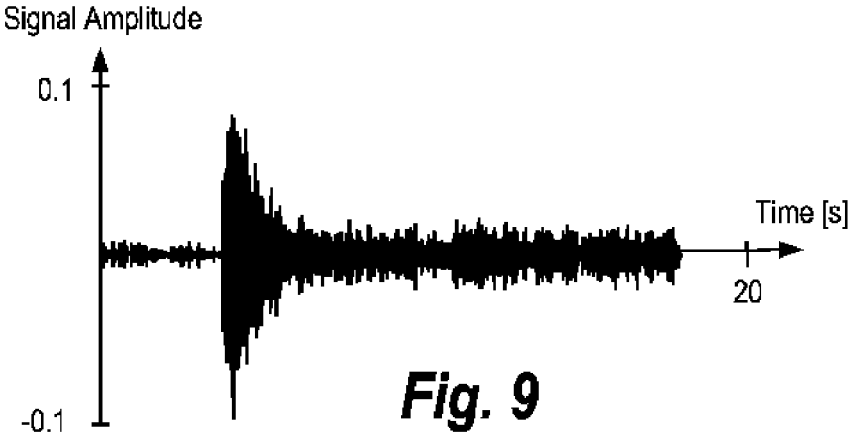
FIG. 9 illustrates a simulation of the signal output from a compressor system according to the present invention using as input the signal from FIG. 8.

FIG. 9 illustrates the amplified signal according to an embodiment of the present invention, which is similar to the hearing aid shown in FIG. 1.

Figure 10:
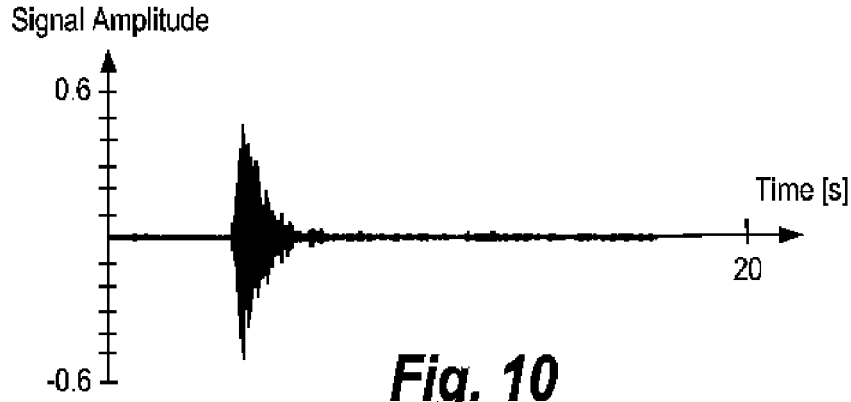
FIG. 10 illustrates a simulation of the signal output from a single compressor system, based on a relatively slow signal level estimation, using as input the signal from FIG. 8.

FIG. 10 illustrates the amplified signal for a configuration with a single compressor and a single signal level estimator having a relatively slow speed. It follows directly that the signal amplitude overshoot, at the beginning of the speech sequence, has increased significantly compared to FIG. 9 (please note the difference in vertical scale).

Figure 11:
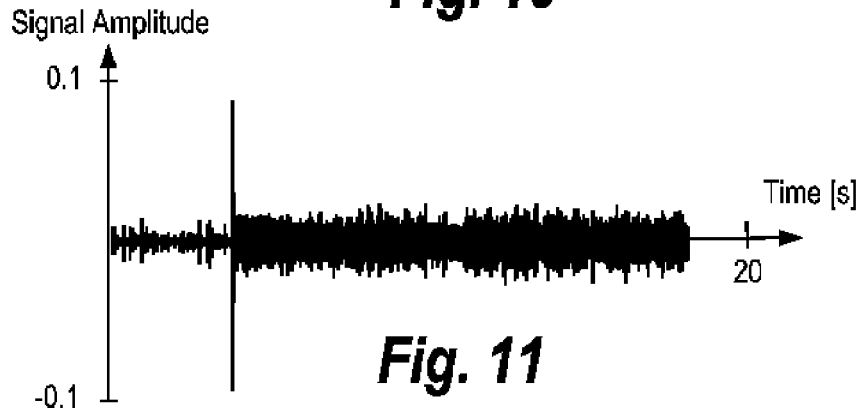
FIG. 11 illustrates a simulation of the signal output from a single compressor system, based on a relatively fast signal level estimation, using as input the signal from FIG. 8.

FIG. 11 illustrates the amplified signal for a configuration with a single compressor and a single signal level estimator having a relatively fast speed. In this case the temporal duration of the signal amplitude overshoot is quickly suppressed and the magnitude of the signal amplitude overshoot is comparable to FIG. 9, but the amplitude modulation of the remaining speech sequence has become more flat compared to FIG. 9, thereby likely to degrade signal quality.

We claim:

1. A method for processing sound signals in a hearing aid, said method comprising transforming an acoustic input sound signal into an electric input signal, estimating a first signal level of the electric input signal based on a first signal level estimator adapted for responding according to a first speed, estimating a second signal level of the electric input signal based on a second signal level estimator adapted for responding according to a second speed, said second speed being lower than said first speed, subtracting said second signal level from said first signal level, thereby forming a third signal level, determining in a first compressor a first compressor gain control output based on said third signal level, determining in a second compressor a second compressor gain control output based on said second signal level, summing said first and second compressor gain control outputs thereby creating a net gain control signal, amplifying said electric input signal in accordance with the net gain control signal thereby creating an electric output signal and transforming said electric output signal into an acoustic output signal.

2. The method according to claim 1, comprising the steps of filtering an electric input signal into a number of frequency bands in order to obtain a set of band split electric input signals and estimating the band split electric input signals based on a set of first signal level estimators and a set of second signal level estimators, thereby forming a set of band split first signal levels and a set of band split second signal levels.

3. The method according to claim 2, comprising the steps of arranging the set of band split first signal levels in at least one first group and arranging the set of band split second signal levels in at least one second group, forming a set of modified band split first signal levels based on the set of band split first signal levels and forming a set of modified band split second signal levels based on the set of band split second signal levels.

4. The method according to claim 3, comprising the step of adaptively controlling the arranging and forming steps based on a sound environment classification unit.

5. The method according to claim 2, comprising the steps of subtracting a modified band split second signal level from the corresponding modified band split first signal level thereby forming a band split third signal level.

6. The method according to claim 1, comprising the steps of estimating at least one of the noise and the signal-to-noise-ratio of an electric input signal and controlling the compression characteristics of a first compressor according to an output from the estimator.

7. The method according to claim 6, wherein a compression ratio of a first compressor is increased when the signal-to-noise ratio is lower than 10 dB.

8. The method according to claim 6, wherein a compression ratio of a first compressor is increased when the signal-to-noise ratio is higher than 20 dB.

9. The method according to claim 1, wherein the first signal level estimator is adapted for responding with attack and release response rates higher than 200 dB/s.

10. The method according to claim 1, wherein the second signal level estimator is adapted for responding with an attack or release response rate lower than 5 dB/s.

11. A hearing aid, comprising an input transducer adapted for transforming an acoustic input sound signal into an electric input signal, a first signal level estimation unit and a second signal level estimation unit, the first signal level estimation unit adapted for having a first speed and the second signal level estimation unit adapted for having a second speed which is lower than the first speed, a subtraction unit configured to subtract the output of the second signal level estimation unit from the output of the first signal level estimation unit thereby forming a third signal level, a first and a second compressor, each compressor configured to determine a respective compressor output based on using respectively said third signal level and said output of the second signal level estimation unit, a summing unit configured to sum the compressor outputs thereby providing a net gain control output, a multiplication unit configured for multiplying said electric input signal by the net gain control output thereby creating an electric output signal, and an output transducer adapted for transforming the electric output signal into an acoustic sound signal.

12. The hearing aid according to claim 11, comprising a band split filter adapted for filtering the electric input signal into a set of frequency bands in order to obtain a set of band split electric input signals.

13. The hearing aid according to claim 12, comprising a grouping control unit adapted for arranging the signal levels estimated by a set of first signal level estimation units, in at least one first group, and for arranging the signal levels estimated by a set of second signal level estimation units, in at least one second group and for forming a set of modified first signal levels based on the signal levels in the at least one first group and forming a set of modified second signal levels based on the signal levels in the at least one second group.

14. The hearing aid according to claim 13, comprising a sound environment classification unit configured for adaptively controlling the grouping control unit.

15. The hearing aid according to claim 11, wherein the compression characteristics of a first compressor comprises a first compression ratio within a first range of compressor input levels and wherein the first range includes the level of zero, a second compression ratio within a second range of compressor input levels and wherein the second range comprises input levels smaller than zero, a third compression ratio within a third range of compressor input levels and wherein the third range comprises input levels larger than zero, and wherein said first, second and third range together span a continuous range and wherein the first compression ratio is smaller than the second compression ratio and smaller than the third compression ratio.

16. The hearing aid according to claim 15, wherein the values of the absolute gain in said first range are smaller than the values of the absolute gain in the second range and smaller than the values of the absolute gain in the third range.

17. The hearing aid according to claim 15, wherein the absolute gain value of zero is included in said first range.

18. The hearing aid according to claim 11, comprising an estimator for estimating at least one of the noise and the signal-to-noise-ratio of an electric input signal, and a controlling unit for controlling the compressor characteristics of a first compressor according to an output from the estimator.

* * * * *